US012616872B2

(12) United States Patent
Chiu

(10) Patent No.: US 12,616,872 B2
(45) Date of Patent: May 5, 2026

(54) MULTI-ANGLE FINE-ADJUSTABLE BAR

(71) Applicant: Tong Xin Sports Development Industry Co., Ltd., Minxiong Township (TW)

(72) Inventor: Kai-Cheng Chiu, Minxiong Township (TW)

(73) Assignee: Tong Xin Sports Development Industry Co., Ltd., Minxiong Township (TW)

( * ) Notice: Subject to any disclaimer, the term of this patent is extended or adjusted under 35 U.S.C. 154(b) by 133 days.

(21) Appl. No.: 18/767,507

(22) Filed: Jul. 9, 2024

(65) Prior Publication Data

US 2026/0014413 A1 Jan. 15, 2026

(51) Int. Cl.
*A63B 21/00* (2006.01)
*A63B 21/068* (2006.01)
*A63B 23/12* (2006.01)

(52) U.S. Cl.
CPC .... *A63B 21/4035* (2015.10); *A63B 21/00047* (2013.01); *A63B 21/068* (2013.01); *A63B 23/1227* (2013.01); *A63B 2225/09* (2013.01)

(58) Field of Classification Search
CPC ..... A63B 21/00047; A63B 21/068; A63B 21/159; A63B 21/4035; A63B 21/4047; A63B 21/4049; A63B 23/1227; A63B 2225/09
See application file for complete search history.

(56) References Cited

U.S. PATENT DOCUMENTS 4,620,701 A * 11/1986 Mojden ..... A63B 3/00 482/142
4,674,160 A * 6/1987 Gibson ..... A63B 21/4047 482/97
5,755,646 A * 5/1998 Chu ..... A63B 21/4001 482/118
6,342,033 B1 * 1/2002 Walker ..... A63B 21/015 482/114

(Continued)

FOREIGN PATENT DOCUMENTS

CN 114404897 A 4/2022
EP 2537564 B1 * 8/2019 ..... A63B 21/00047

(Continued)

*Primary Examiner* — Gary D Urbiel Goldner
(74) *Attorney, Agent, or Firm* — Best & Flanagan LLP

(57) ABSTRACT

A multi-angle fine-adjustable bar comprises a support rod, an angle fine-adjustable disk and a position-limiting seat. The support rod is provided with a first pivot part connected to a first limiting part. The angle fine-adjustable disk is provided with a first angle selection area having first angle positioning parts and a second angle selection area having second angle positioning parts respectively disposed at two ends of a second pivot part of the angle fine-adjustable disk. The position-limiting seat is provided with a third pivot part connected to a second bearing part. The first, second, and third pivot parts are pivotally connected with one another, and a second limiting part is provided at one end of the second bearing part, so that the first and second limiting parts are optionally combined with any one of the first angle positioning parts and any one of the second angle positioning parts, respectively.

9 Claims, 10 Drawing Sheets

(56) References Cited

U.S. PATENT DOCUMENTS

| | | | | |
|---|---|---|---|---|
| 6,508,743 | B1 * | 1/2003 | Fortin | A63B 1/00 482/40 |
| 7,108,636 | B1 * | 9/2006 | Garcia | A63B 21/1627 482/141 |
| 7,637,851 | B1 * | 12/2009 | Lormil | A63B 21/4035 482/141 |
| 2010/0144492 | A1 * | 6/2010 | Ruan | A63B 21/4003 482/10 |
| 2011/0071004 | A1 * | 3/2011 | Murphy | A63B 23/1209 482/23 |
| 2012/0010058 | A1 * | 1/2012 | Sprague | A63B 21/0004 482/141 |
| 2012/0231937 | A1 * | 9/2012 | Murphy | A63B 23/1236 482/93 |
| 2017/0056711 | A1 * | 3/2017 | Dalebout | A61B 5/6895 |
| 2017/0056715 | A1 * | 3/2017 | Dalebout | G06V 40/23 |
| 2017/0056726 | A1 * | 3/2017 | Dalebout | A63B 22/0235 |
| 2017/0354838 | A1 * | 12/2017 | Fitzpatrick | A63B 1/00 |
| 2023/0081926 | A1 * | 3/2023 | Chang | A63B 23/03541 482/97 |

FOREIGN PATENT DOCUMENTS

| | | | | | |
|---|---|---|---|---|---|
| JP | 2014502202 | A | * | 1/2014 | A63B 21/00047 |
| JP | 2021-090509 | A | | 6/2021 | |
| KR | 102090777 | B1 | * | 3/2020 | A63B 23/12 |
| KR | 20200125418 | A | * | 11/2020 | A63B 21/0626 |
| TW | 629171 | U | * | 7/2022 | |
| TW | 1897336 | B | * | 9/2025 | |

* cited by examiner

MULTI-ANGLE FINE-ADJUSTABLE BAR

FIELD OF THE INVENTION

The invention relates to a bar, more particularly to a multi-angle fine-adjustable bar.

DESCRIPTION OF THE RELATED ART

The advantage of using a bar for fitness is that it is convenient, reduces the need for space, and can train the body's coordination and stability without the need for special equipment. Therefore, the industry has introduced fitness equipment that combines bars. However, as shown in FIG. 10 of Taiwan Patent Publication No. TWM522048U, the handle of the lower bar cannot be adjusted to multiple angles. It can only stimulate muscle groups at a single angle and cannot train different muscle groups flexibly, resulting in poor fitness results.

SUMMARY OF THE INVENTION

An object of the invention is to provide a multi-angle fine-adjustable bar, so as to solve the problems mentioned in the prior art.

According to one embodiment of the invention, a multi-angle fine-adjustable bar is provided, the bar comprises a support rod, an angle fine-adjustable disk and a position-limiting seat, wherein the support rod is provided with a first bearing part and a first pivot part connected to one end of the first bearing part, one end of the first pivot part is provided with a first limiting part; the angle fine-adjustable disk is provided with a second pivot part, a first angle selection area and a second angle selection area are disposed at two ends of the second pivot part, the first angle selection area corresponds to the first limiting part, the first angle selection area is provided with a plurality of first angle positioning parts arranged at intervals, the second angle selection area is provided with a plurality of second angle positioning parts arranged at intervals; the position-limiting seat is provided with a third pivot part and a second bearing part connected to one end of the third pivot part, the first pivot part, the second pivot part and the third pivot part are pivotally connected with one another, one end of the second bearing part is provided with a second limiting part corresponding to the second angle selection area, the first limiting part is optionally combined with any one of the plurality of first angle positioning parts, and the second limiting part is optionally combined with any one of the plurality of second angle positioning parts.

The multi-angle fine-adjustable bar, wherein the first pivot part is provided with a first pivot hole, the second pivot part is provided with a second pivot hole, the third pivot part is provided with a first pivot post, the first pivot hole of the first pivot part and the second pivot hole of the second pivot part are pivotally disposed on the first pivot post of the third pivot part.

The multi-angle fine-adjustable bar, wherein the first limiting part is provided with a first protruding part, one end of the first protruding part is inserted into a first groove recessed on a periphery of one end of the first pivot part, another end of the first protruding part is exposed outside the first pivot part, the plurality of first angle positioning parts are provided with a second grooves, the second grooves are recessed on a periphery of one end of the second pivot part, the first protruding part of the first limiting part is optionally combined with the second groove of any one of the plurality of first angle positioning parts.

The multi-angle fine-adjustable bar, wherein the first limiting part is provided with a first protruding tooth, the first protruding tooth protrudes from a periphery of one end of the first pivot part, the plurality of first angle positioning parts are provided with a first concave teeth, the first concave teeth are recessed on a periphery of one end of the second pivot part, the first protruding tooth of the first limiting part is optionally combined with the first concave tooth of any one of the plurality of first angle positioning parts.

The multi-angle fine-adjustable bar, wherein the plurality of second angle positioning parts are provided with a third grooves, the third grooves are recessed on a periphery of another end of the second pivot part, the second limiting part is provided with a second protruding part, one end of the second protruding part is inserted into a fourth groove recessed on a periphery of one end of the second bearing part, another end of the second protruding part is exposed outside the second bearing part, the second protruding part of the second limiting part is optionally combined with the third groove of any one of the plurality of second angle positioning parts.

The multi-angle fine-adjustable bar, wherein the plurality of second angle positioning parts are provided with a second concave teeth, the second concave teeth are recessed on a periphery of another end of the second pivot part, the second limiting part is provided with a second protruding tooth, the second protruding tooth protrudes from a periphery of one end of the second bearing part, the second protruding tooth of the second limiting part is optionally combined with the second concave tooth of any one of the plurality of second angle positioning parts.

The multi-angle fine-adjustable bar, wherein quantities of the plurality of second angle positioning parts and the plurality of first angle positioning parts are equal or unequal, positions of the plurality of second angle positioning parts and the plurality of first angle positioning parts are disposed relative to one another or offset from one another, the plurality of first angle positioning parts of the first angle selection area and the plurality of second angle positioning parts of the second angle selection area completely overlap or partially overlap with one another.

The multi-angle fine-adjustable bar, wherein the third pivot part is provided with a first blocking part at another end to butt against another end of the first pivot part, the first blocking part is provided with a bolt, one end of the bolt is locked to a screw hole recessed at another end of the third pivot part, and another end of the bolt is exposed outside the third pivot part and butts against another end of the first pivot part.

The multi-angle fine-adjustable bar, wherein anther end of the second bearing part of the position-limiting seat is provided with a first assembling part assembled on a first joint part of a bearing frame, the first joint part is connected to a first connecting part.

According to one embodiment of the invention, a bearing frame with a multi-angle fine-adjustable bar is provided, comprises a bearing frame and a multi-angle fine-adjustable bar, wherein the bearing frame is provided with a first joint part and a first connecting part connected to the first joint part, the first connecting part is assembled at a predetermined position; anther end of the second bearing part of the position-limiting seat of the bar is provided with a first assembling part assembled on the first joint part of the bearing frame.

The multi-angle fine-adjustable bar of the invention is capable of stimulating muscle groups with fine-adjusting from multiple angles, providing flexible training for different muscle groups, and avoiding poor fitness results.

The multi-angle fine-adjustable bar of the invention is assembled with the bearing frame, making it convenient to disassemble, assemble and fold.

Numerous objects, features and advantages of the invention will be readily apparent upon a reading of the following detailed description of embodiments of the invention when taken in conjunction with the accompanying drawings. However, the drawings employed herein are for the purpose of descriptions and should not be regarded as limiting.

BRIEF DESCRIPTION OF DRAWINGS

The above objects and advantages of the invention will become more readily apparent to those ordinarily skilled in the art after reviewing the following detailed description and accompanying drawings, in which.

DETAILED DESCRIPTION OF THE INVENTION

Figure 1:
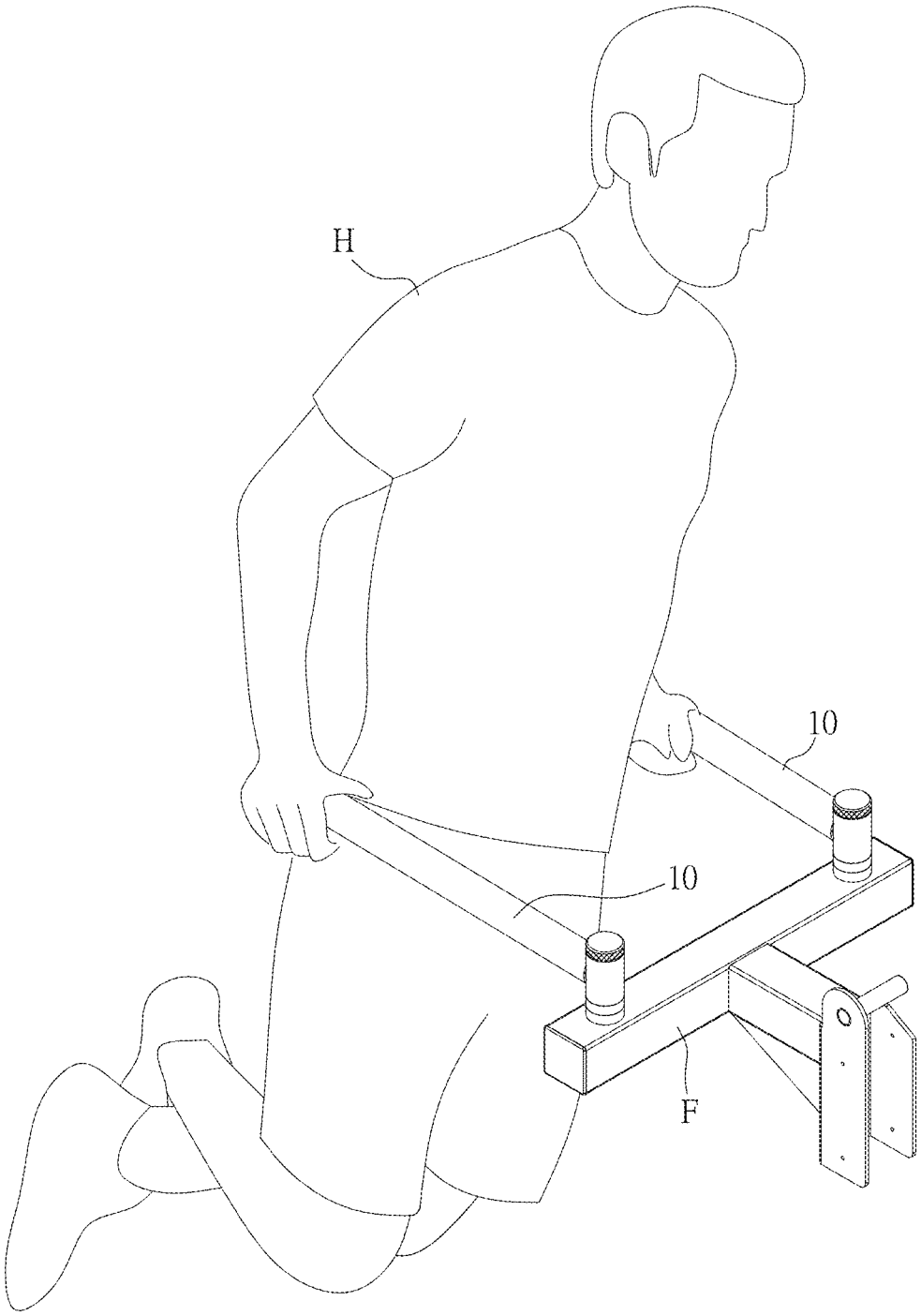
FIG. 1 is a perspective assembled view and use status of a multi-angle fine-adjustable bar of the invention.
Figure 2:
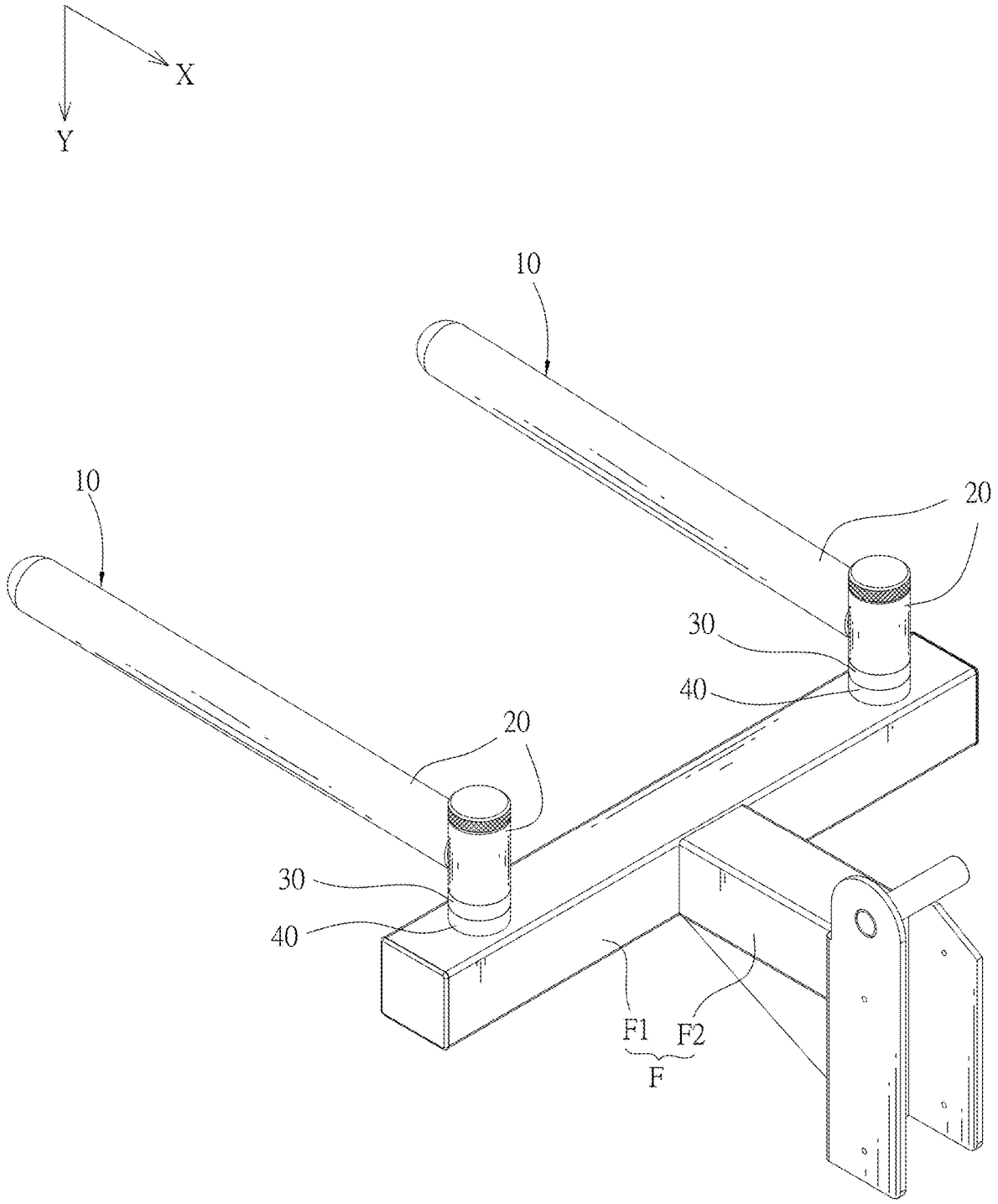
FIG. 2 is a perspective assembled view of the multi-angle fine-adjustable bar of the invention.
Figure 3:
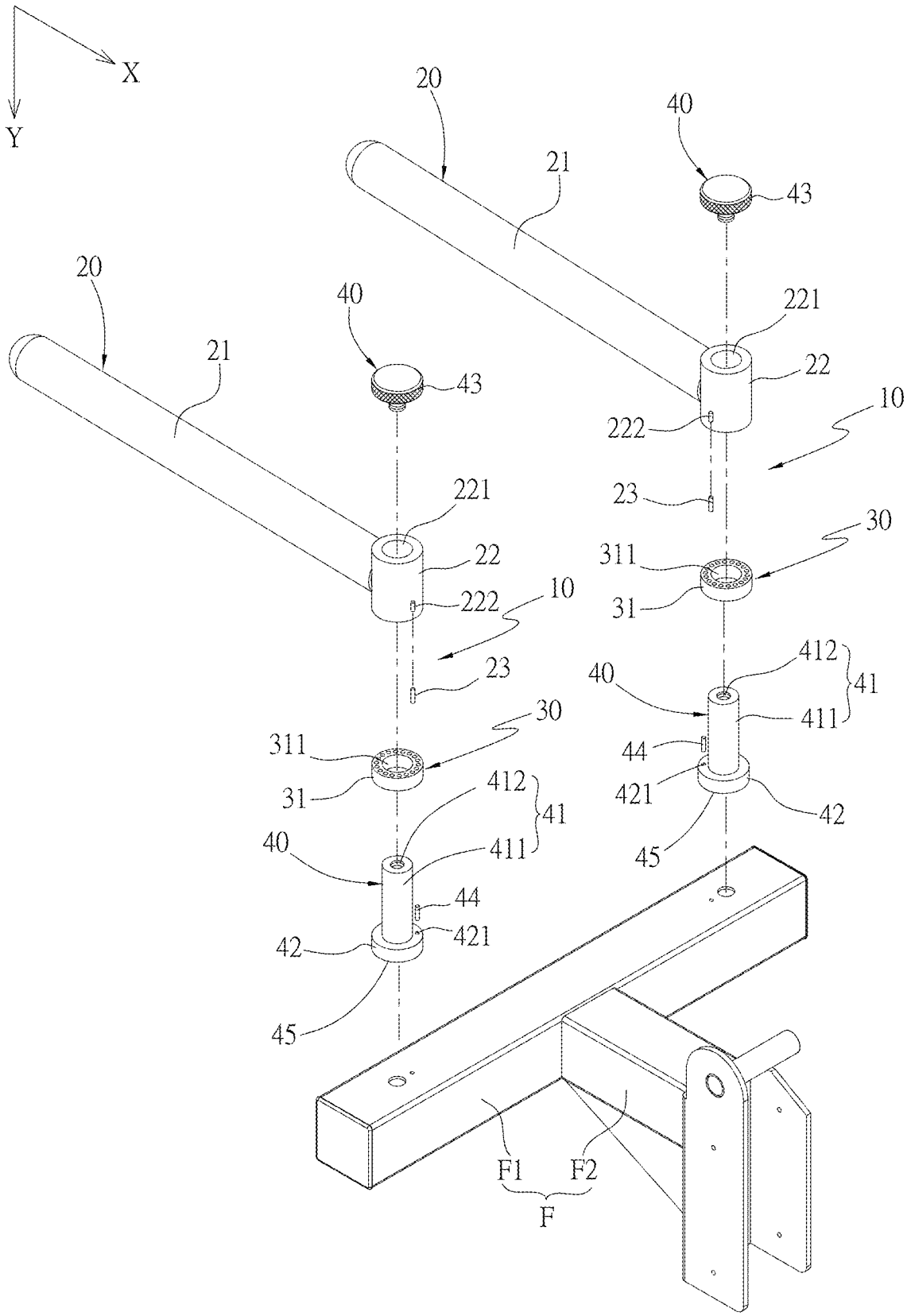
FIG. 3 is an exploded view of the multi-angle fine-adjustable bar of the invention.
Figure 4:
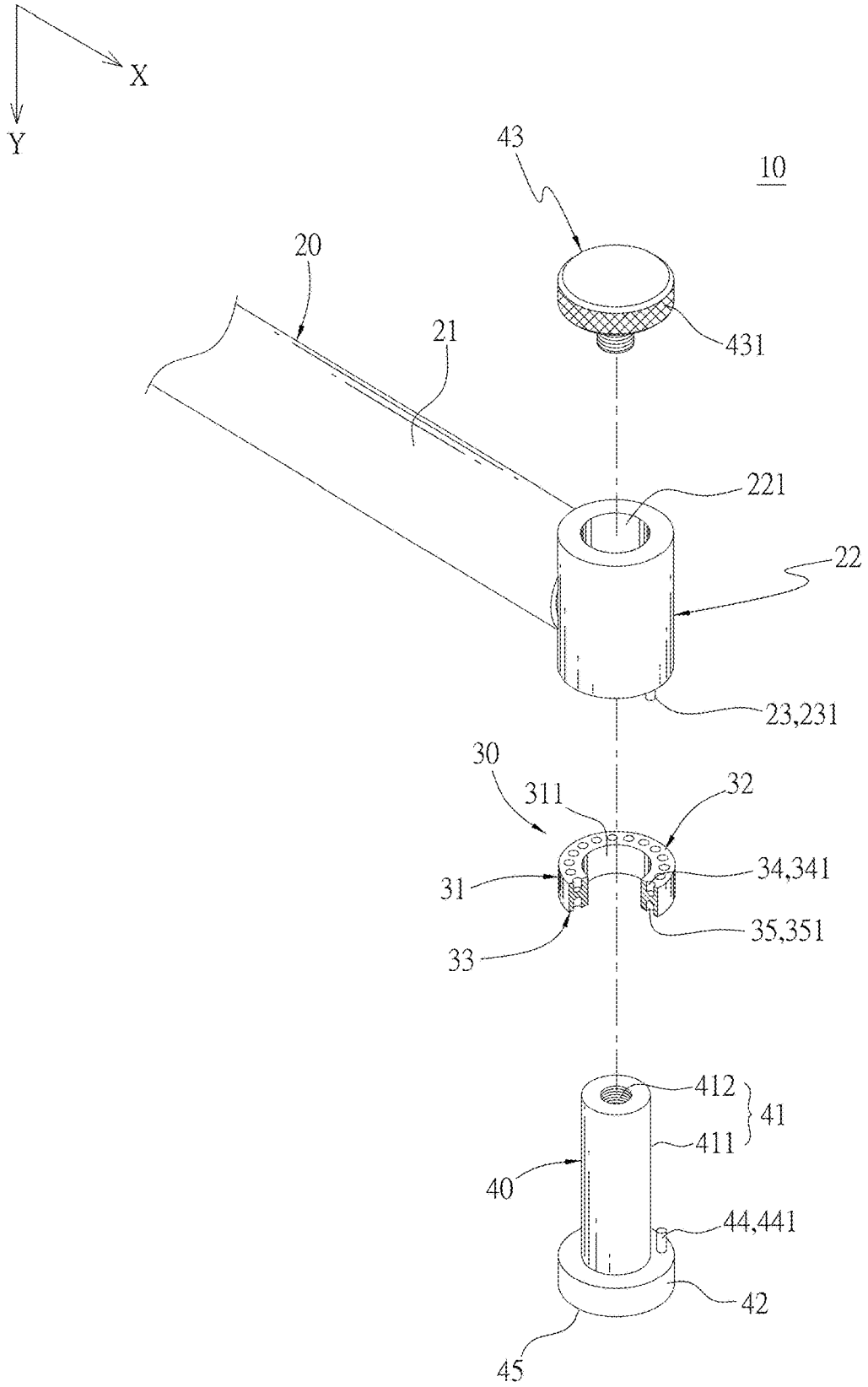
FIG. 4 is a partial exploded view of FIG. 3 of the multi-angle fine-adjustable bar of the invention.
Figure 5:
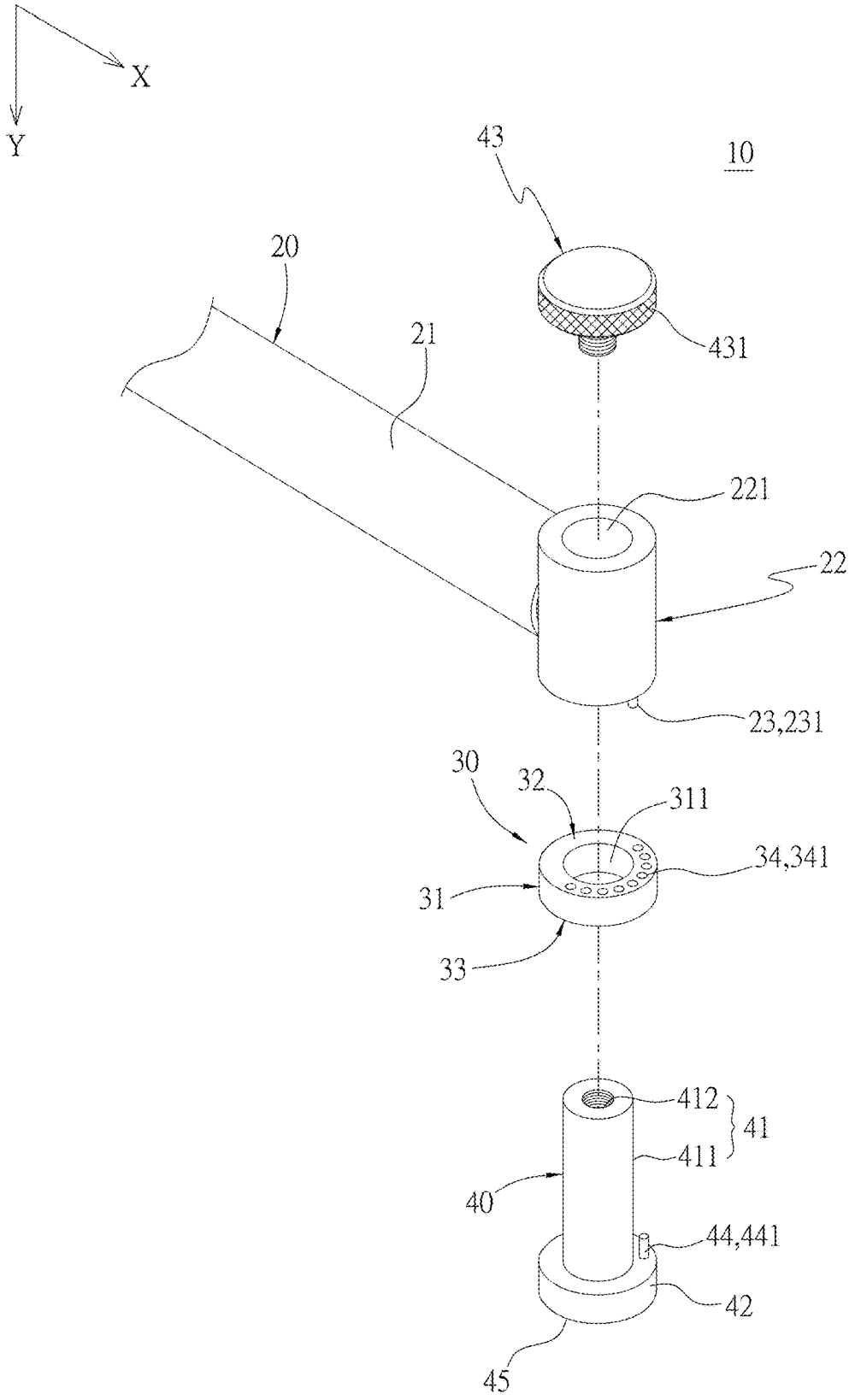
FIG. 5 is a first deformed exploded view of FIG. 4 of the multi-angle fine-adjustable bar of the invention.
Figure 6:
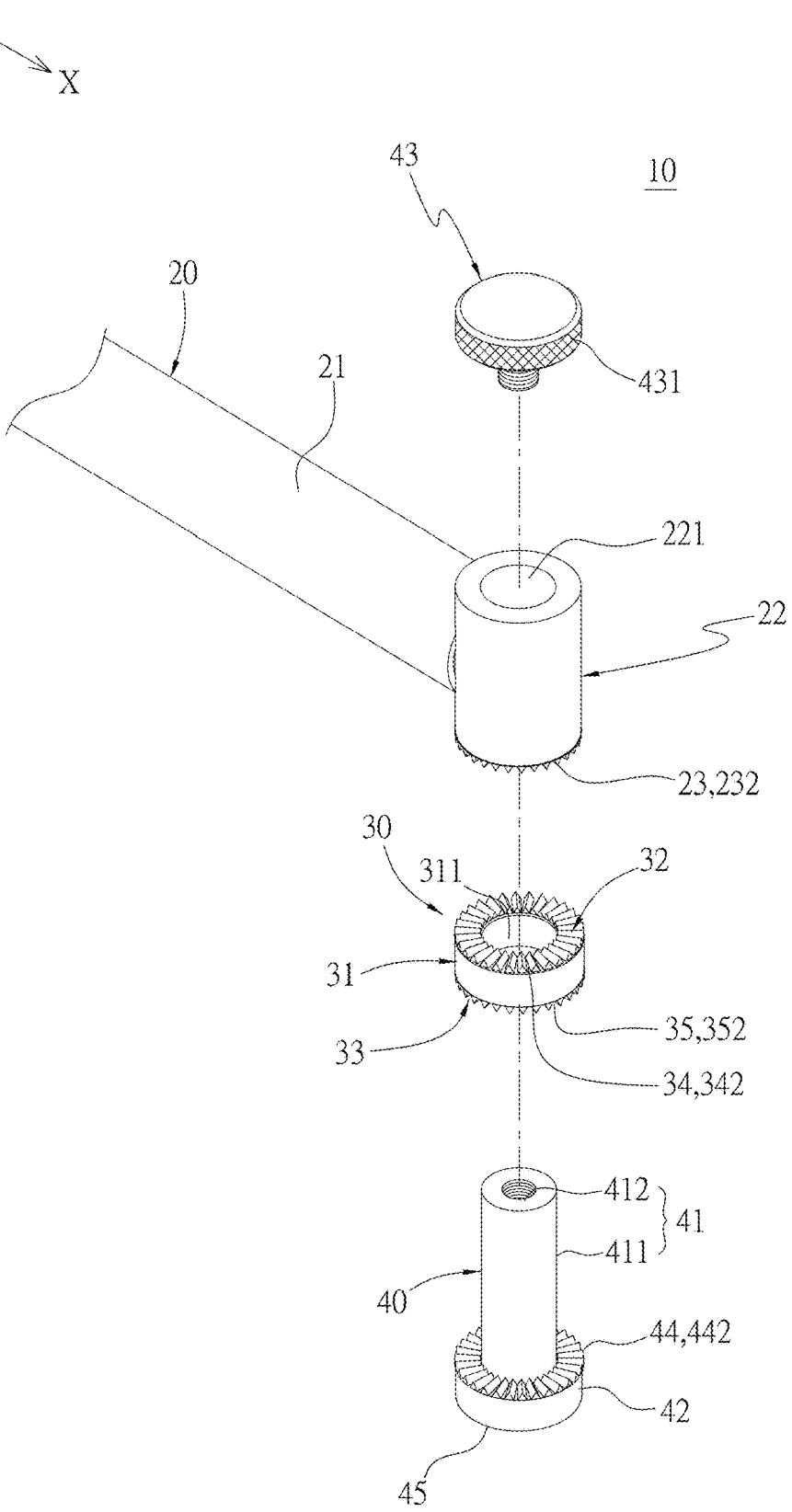
FIG. 6 is a second deformed exploded view of FIG. 4 of the multi-angle fine-adjustable bar of the invention.
Figure 7:
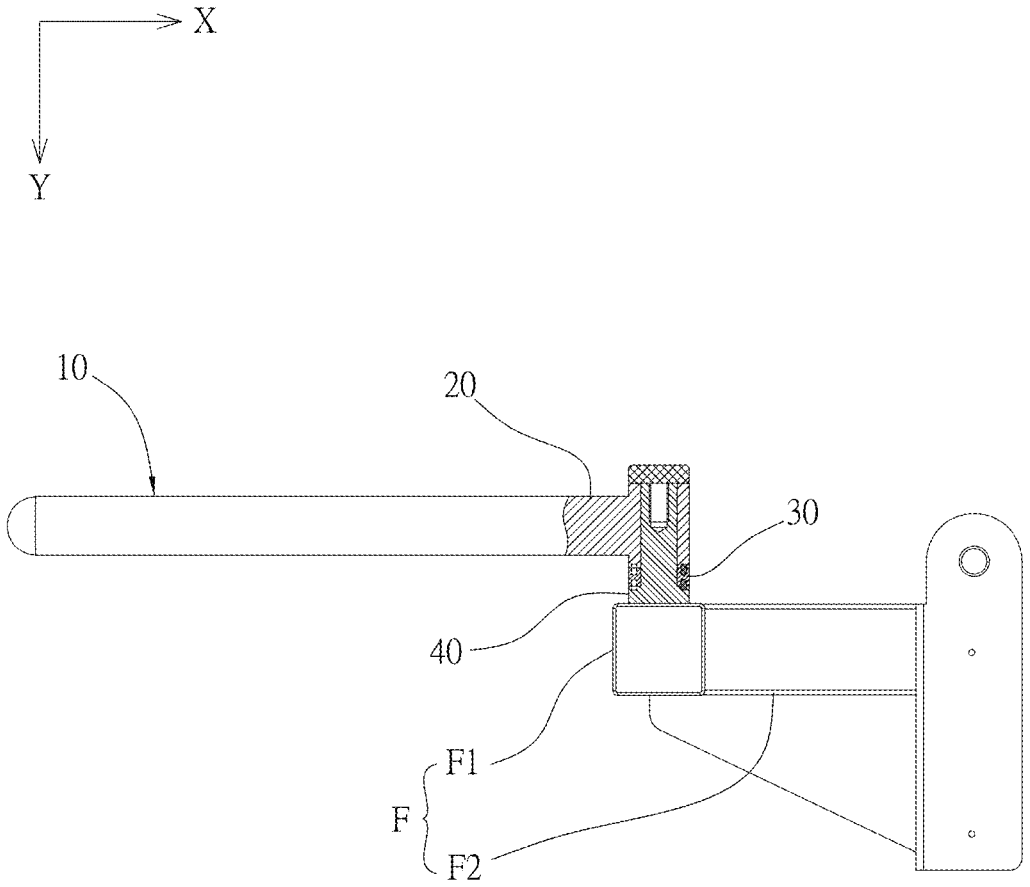
FIG. 7 is a partial plane cross-sectional view of the multi-angle fine-adjustable bar of the invention.
Figure 8:
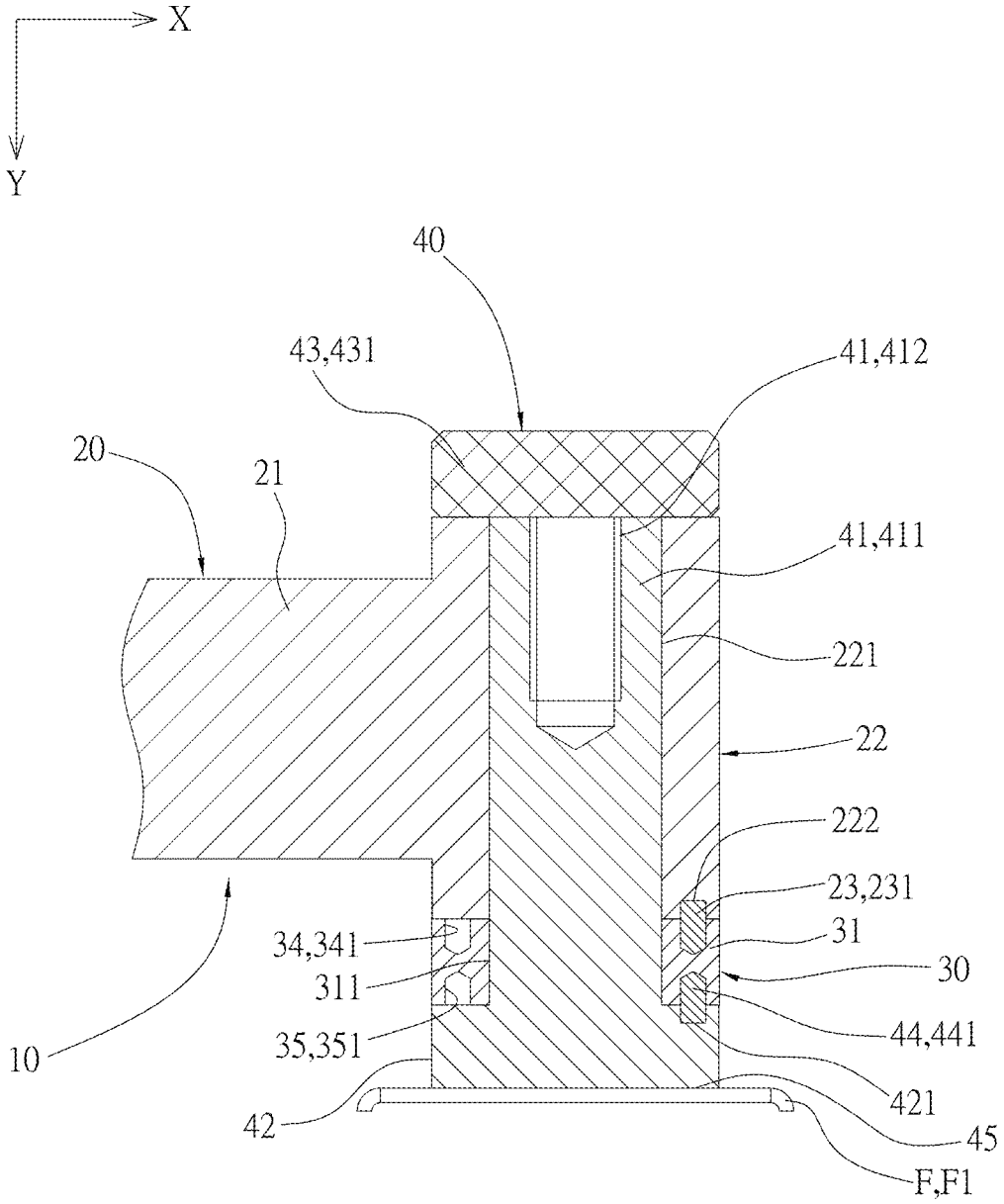
FIG. 8 is a partially enlarged plan assembly view of FIG. 7 of the multi-angle fine-adjustable bar of the invention.
Figure 9:
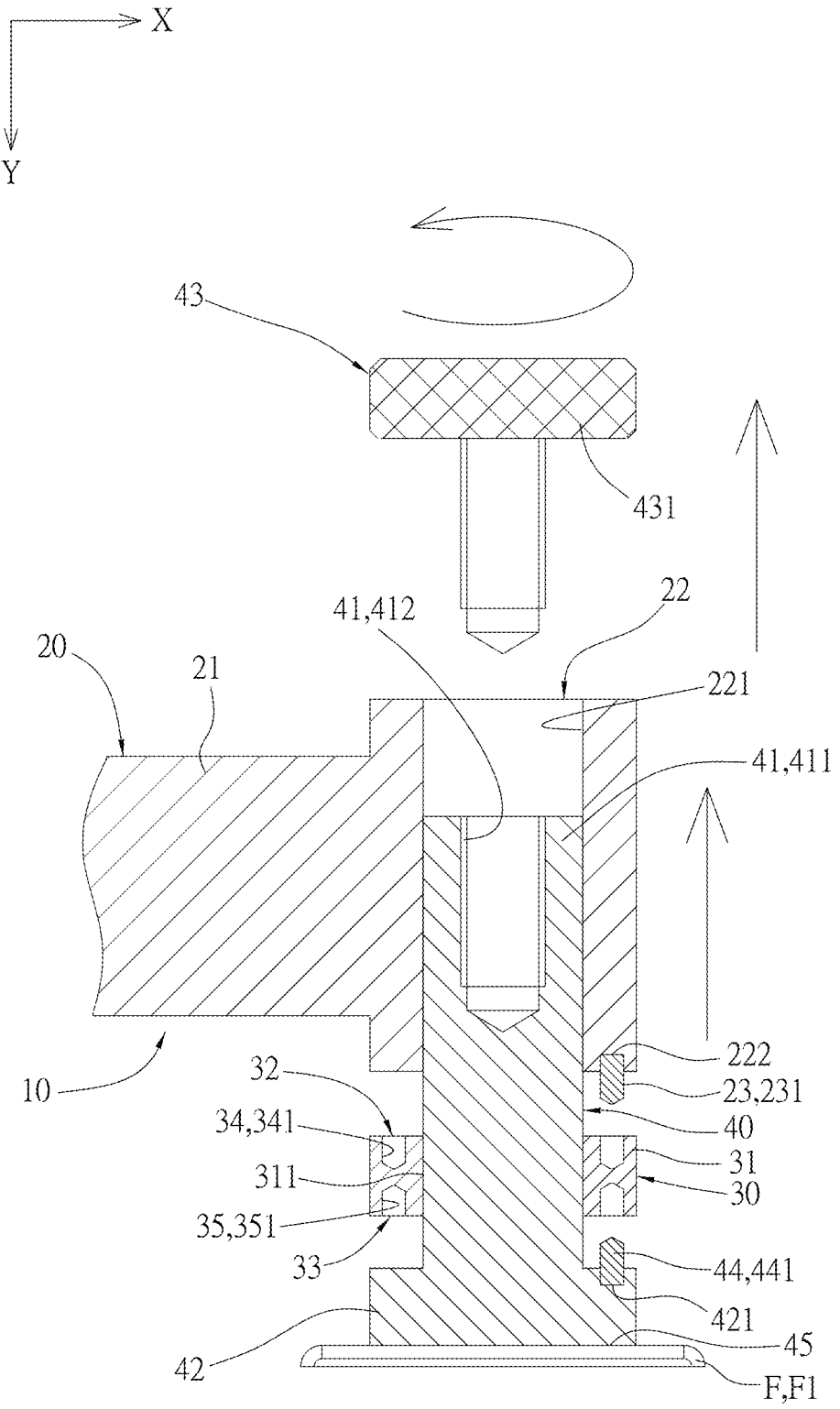
FIG. 9 is a partially enlarged plan exploded view of FIG. 7 and action diagram of the multi-angle fine-adjustable bar of the invention.
Figure 10:
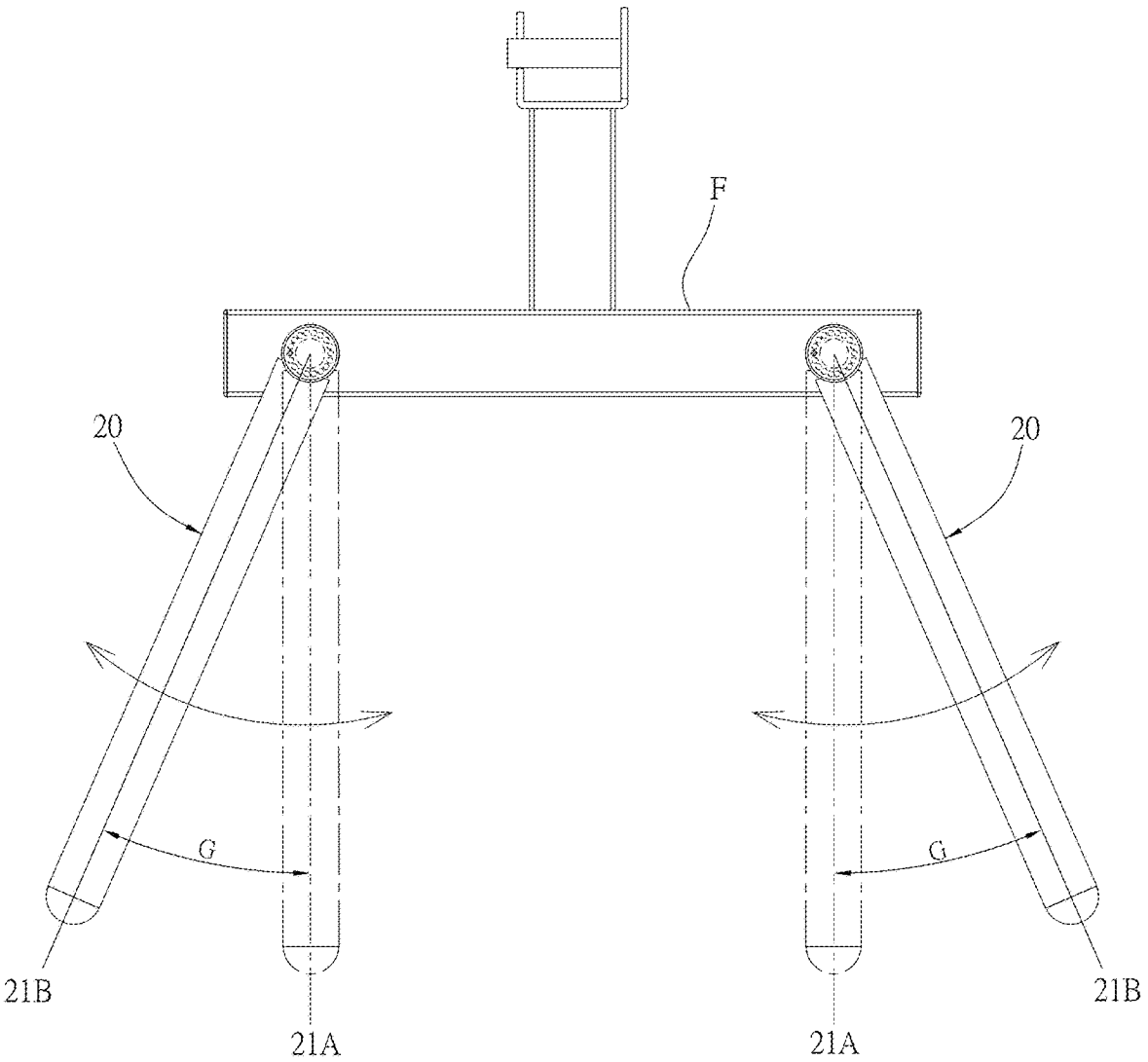
FIG. 10 is a schematic diagram of multi-angle fine-adjusting of the multi-angle fine-adjustable bar of the invention.

Please refer to FIGS. 1 to 10. The invention provides a multi-angle fine-adjustable bar and a bearing frame with the multi-angle fine-adjustable bar.

A multi-angle fine-adjustable bar 10 is called a horizontal bar, and the two multi-angle fine-adjustable bars 10 are called parallel bars. An appropriate number of the bar 10 is selected according to fitness requirements. The invention uses the two multi-angle fine-adjustable bars 10 (please refer to FIG. 1) as an embodiment, and uses a human body H to indicate a use state, and a bearing frame F to indicate a use state.

The multi-angle fine-adjustable bar 10 (please refer to FIG. 1 to FIG. 10) defines a first direction X and a second direction Y intersecting the first direction X. The multi-angle fine-adjustable bar 10 comprises a support rod 20, an angle fine-adjustable disk 30, and a position-limiting seat 40.

The support rod 20 (please refer to FIG. 2 to FIG. 10) is described as follows.

The support rod 20 is provided with a first bearing part 21 and a first pivot part 22 connected to one end of the first bearing part 21.

The first bearing part 21 is formed into a column along the first direction X, and the first bearing part 21 provides a hand grip for the human body H.

The first pivot part 22 is formed into a hollow column with two ends open along the second direction Y. In one embodiment, the first pivot part 22 is provided with a first pivot hole 221. One end of the first bearing part 21 is connected to a side of the first pivot part 22, and one end of the first pivot part 22 is provided with a first limiting part 23.

The first limiting part 23 is formed into a column along the second direction Y. The first limiting part 23 and the first pivot part 22 can be composed of independent components. In one embodiment, the first limiting part 23 is provided with a first protruding part 231. One end of the first protruding part 231 is inserted into a first groove 222 recessed on a periphery of one end of the first pivot part 22 along the second direction Y, and another end of the first protruding part 231 is exposed outside the first pivot part 22 along the second direction Y.

The first limiting part 23 and the first pivot part 22 can also be formed by integral components. In another embodiment, the first limiting part 23 is provided with a first protrusion (not shown in the figures), and the first protrusion protrudes along the second direction Y from a periphery of one end of the first pivot part 22. In addition, in another embodiment, the first limiting part 23 is provided with a first protruding tooth 232 (please refer to FIG. 6). The first protruding tooth 232 protrudes from a periphery of one end of the first pivot part 22 along the second direction Y. When the first protruding teeth 232 are provided, the first protruding teeth 232 are arranged at intervals in a closed and/or an open ring shape.

The angle fine-adjustable disk 30 (please refer to FIG. 2 to FIG. 9) is described as follows.

The angle fine-adjustable disk 30 is formed into a hollow column with two ends open along the second direction Y.

The angle fine-adjustable disk 30 is provided with a second pivot part 31 along the second direction Y corresponding to the first pivot part 22 of the support rod 20. In one embodiment, the second pivot part 31 is provided with a second pivot hole 311.

The angle fine-adjustable disk 30 is provided with a first angle selection area 32 and a second angle selection area 33 on peripheries of two ends of the second pivot part 31 along the second direction Y.

The first angle selection area 32 is provided with a plurality of first angle positioning parts 34 entirely (please refer to FIG. 4) or partially (please refer to FIG. 5), and the first angle positioning parts 34 are equidistantly and/or non-equidistantly arranged at intervals in the first angle selection area 32.

The first angle positioning parts 34 and the second pivot part 31 can be formed by integral components. In one embodiment, the first angle positioning parts 34 are provided with a second grooves 341, and the second grooves 341 are recessed on a periphery of one end of the second pivot part 31 along the second direction Y in a closed and/or an open ring shape. In addition, in another embodiment, the first angle positioning parts 34 are provided with a first concave teeth 342. The first concave teeth 342 are recessed on a periphery of one end of the second pivot part 31 along the second direction Y in a closed and/or an open ring shape.

Thereby, the first limiting part 23 of the support rod 20 can be optionally combined with any one of the first angle positioning parts 34. That is to say, the first protruding part 231, the first protrusion or the first protruding tooth 232 of the first limiting part 23 can be optionally combined with the second grooves 341 or the first concave tooth 342 of any one of the first angle positioning parts 34, a combination method can be insertion fitting (a protruding part or a protrusion fit into a groove) or snap-in engagement (a protruding tooth fit into a concave tooth). The first limiting part 23 and the first angle positioning parts 34 can be interchangeable structures.

The second angle selection area 33 is provided with a plurality of second angle positioning parts 35 entirely (please refer to the first angle selection area 32 in FIG. 4) or partially (please refer to the first angle selection area 32 in FIG. 5), and the second angle positioning parts 35 are equidistantly and/or non-equidistantly arranged at intervals in the second angle selection area 33.

The second angle positioning parts 35 and the second pivot part 31 can be formed by integral components. In one embodiment, the second angle positioning parts 35 are provided with a third grooves 351, and the third grooves 351 are recessed on a periphery of another end of the second pivot part 31 along the second direction Y in a closed and/or an open ring shape. In addition, in another embodiment, the second angle positioning parts 35 are provided with a second concave teeth 352. The second concave teeth 352 are recessed on a periphery of another end of the second pivot part 31 along the second direction Y in a closed and/or an open ring shape.

In addition, quantities of the third grooves 351 of the second angle positioning parts 35 and the second grooves 341 of the first angle positioning parts 34 can be equal or unequal, and positions thereof can be disposed relative to one another or offset from one another. The aforementioned limitations also apply to the second concave teeth 352 and the first concave teeth 342. The first angle selection area 32 to which the first angle positioning parts 34 belong and the second angle selection area 33 to which the second angle positioning parts 35 belong can completely overlap or partially overlap with one another along the second direction Y.

Relationship between the second angle positioning parts 35 of the second angle selection area 33 and the position-limiting seat 40 will be described hereinafter.

The position-limiting seat 40 (please refer to FIGS. 2 to 9) is described as follows.

The position-limiting seat 40 is formed into a column along the second direction Y. The position-limiting seat 40 is provided with a third pivot part 41 with a smaller diameter and a second bearing part 42 with a larger diameter connected to one end of the third pivot part 41.

In one embodiment, the third pivot part 41 is provided with a first pivot post 411. The first pivot part 22 of the support rod 20 and the second pivot part 31 of the angle fine-adjustable disk 30 are pivotally disposed on the third pivot part 41 of the position-limiting seat 40 and are capable of pivoting. That is to say, at this time, the first pivot part 22, the second pivot part 31 and the third pivot part 41 are pivotally connected with one another.

The third pivot part 41 (please refer to FIG. 8 to FIG. 9) is provided with a first blocking part 43 at another end along the second direction Y to butt against another end of the first pivot part 22 to restrict displacement of the first pivot part 22 of the support rod 20 and the angle fine-adjustable disk 30 along the second direction Y. Disassembly and assembly of the first blocking part 43 are capable of ensuring that multi-angle fine-adjusting is not changed after completion, and also facilitating optional combination between a second limiting part 44 (or the first limiting part 23) and the second angle positioning parts 35 (or the first angle positioning parts 34) during multi-angle fine-adjusting.

The first blocking part 43 (please refer to FIGS. 8 to 9) and the third pivot part 41 can be composed of independent components. In one embodiment, the first blocking part 43 is provided with a bolt 431, one end of the bolt 431 is locked to a screw hole 412 recessed along the second direction Y at another end of the third pivot part 41, and another end of the bolt 431 is exposed outside the third pivot part 41 along the second direction Y and butts against another end of the first pivot part 22.

The second bearing part 42 is provided with the second limiting part 44 and a first assembling part 45 at two ends along the second direction Y.

The second limiting part 44 is formed into a column along the second direction Y. The second limiting part 44 and the second bearing part 42 can be composed of independent components. In one embodiment, the second limiting part 44 is provided with a second protruding part 441. One end of the second protruding part 441 is inserted into a fourth groove 421 recessed on a periphery of one end of the second bearing part 42 along the second direction Y, and another end of the second protruding part 441 is exposed outside the second bearing part 42 along the second direction Y.

The second limiting part 44 and the second bearing part 42 can also be formed by integral components. In another embodiment, the second limiting part 44 is provided with a second protrusion (not shown in the figures), and the second protrusion protrudes along the second direction Y from a periphery of one end of the second bearing part 42. In addition, in another embodiment, the second limiting part 44 is provided with a second protruding tooth 442. The second protruding tooth 442 protrudes from a periphery of one end of the second bearing part 42 along the second direction Y. When the second protruding teeth 442 are provided, the second protruding teeth 442 are arranged at intervals in a closed and/or an open ring shape.

Another end of the second bearing part 42 of the position-limiting seat 40 is assembled at a predetermined position with the first assembling part 45. An assembly method can be locking for convenient disassembly or pivoting for convenient folding. The predetermined position can be the bearing frame F or fitness equipment.

Thereby, the second limiting part 44 of the position-limiting seat 40 can be optionally combined with any one of the second angle positioning parts 35. That is to say, the second protruding part 441, the second protrusion or the second protruding tooth 442 of the second limiting part 44 can be optionally combined with the third grooves 351 or the second concave tooth 352 of any one of the second angle positioning parts 35, a combination method can be insertion fitting (a protruding part or a protrusion fit into a groove) or snap-in engagement (a protruding tooth fit into a concave tooth). The second limiting part 44 and the second angle positioning parts 35 can be interchangeable structures.

The second limiting part 44 of the position-limiting seat 40 can be optionally combined with any one of the second angle positioning parts 35, and the first limiting part 23 of the support rod 20 can be optionally combined with any one of the first angle positioning parts 34, in order to define an adjustment angle G (please refer to FIG. 10) to facilitate multi-angle fine-adjusting. The adjustment angle G is formed by the support rod 20 defining a starting line 21A before adjustment and an ending line 21B after adjustment.

Therefore, the multi-angle fine-adjustable bar 10 is capable of stimulating muscle groups with fine-adjusting from multiple angles, providing flexible training for different muscle groups, and avoiding poor fitness results.

The multi-angle fine-adjustable bar 10 is assembled on the bearing frame F and is described as follows.

The bearing frame F is laterally provided with a first joint part F1 and a first connecting part F2 that is laterally connected to the first joint part F1. An appearance of the first joint part F1 is approximately a straight line, and an appearance of the first connecting part F2 is approximately an inverted L shape. Direction or position in which the first joint part F1 and the first connecting part F2 are connected to each other can be changed as required.

The position-limiting seat 40 of the multi-angle fine-adjustable bar 10 is assembled on the first joint part F1 of the bearing frame F with the first assembling part 45, an assembly method can be locking for convenient disassembly. The bearing frame F is assembled at a predetermined position with the first connecting part F2, an assembly method can be locking for convenient disassembly, or pivoting for convenient folding. The predetermined position can be fitness equipment.

Descriptions such as "first", "second", "third" and "fourth" mentioned in the invention are for distinction and do not represent a sequence. Tolerances (permissible error ranges of specific dimensions, such as dimensional tolerances, geometric tolerances or fit tolerances) are covered in the various components mentioned in the invention.

Although the invention has been disclosed as above with the embodiments, it is not intended to limit the invention. A person having ordinary skill in the art to which the invention pertains can make various changes and modifications without departing from the spirit and scope of the invention. Therefore, scope of protection of the invention shall be subject to what is defined in the pending claims.

The benefits and advantages which may be provided by the present invention have been described above with regard to specific embodiments. These benefits and advantages, and any elements or limitations that may cause them to occur or to become more pronounced are not to be construed as critical, required, or essential features of any or all of the embodiments.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention not be limited by this detailed description, but by the claims and the equivalents to the claims appended hereto.

What is claimed is:

1. A multi-angle fine-adjustable bar of a dip bar exercise device, the multi-angle fine-adjustable bar comprising:

a support rod provided with a first bearing part and a first pivot part connected to one end of the first bearing part, one end of the first pivot part being provided with a first limiting part;

an angle fine-adjustable disk provided with a second pivot part, a first angle selection area and a second angle selection area being respectively disposed at two ends of the second pivot part, the first angle selection area corresponding to the first limiting part, the first angle selection area being provided with a plurality of first angle positioning parts arranged at intervals, the second angle selection area being provided with a plurality of second angle positioning parts arranged at intervals; and a position-limiting seat provided with a third pivot part and a second bearing part connected to one end of the third pivot part, the first pivot part, the second pivot part and the third pivot part being pivotally connected with one another, one end of the second bearing part being provided with a second limiting part corresponding to the second angle selection area, the first limiting part being optionally combined with any one of the plurality of first angle positioning parts, and the second limiting part being optionally combined with any one of the plurality of second angle positioning parts.

2. The multi-angle fine-adjustable bar as claimed in claim 1, wherein the first pivot part is provided with a first pivot hole, the second pivot part is provided with a second pivot hole, the third pivot part is provided with a first pivot post, and the first pivot hole of the first pivot part and the second pivot hole of the second pivot part are pivotally disposed on the first pivot post of the third pivot part.

3. The multi-angle fine-adjustable bar as claimed in claim 1, wherein the first limiting part is provided with a first protruding part, one end of the first protruding part is inserted into a first groove recessed on a periphery of one end of the first pivot part, another end of the first protruding part is exposed outside the first pivot part, the plurality of first angle positioning parts are respectively provided with a plurality of second grooves, the plurality of second grooves are recessed on a periphery of a first end of the two ends of the second pivot part, and the first protruding part of the first limiting part is optionally combined with the second groove of any one of the plurality of first angle positioning parts.

4. The multi-angle fine-adjustable bar as claimed in claim 1, wherein the first limiting part is provided with a first protruding tooth, the first protruding tooth protrudes from a periphery of one end of the first pivot part, the plurality of first angle positioning parts are respectively provided with a plurality of first concave teeth, the plurality of first concave teeth are recessed on a periphery of a first end of the two ends of the second pivot part, and the first protruding tooth of the first limiting part is optionally combined with the first concave tooth of any one of the plurality of first angle positioning parts.

5. The multi-angle fine-adjustable bar as claimed in claim 1, wherein the plurality of second angle positioning parts are respectively provided with a plurality of third grooves, the plurality of third grooves are recessed on a periphery of a second end of the two ends of the second pivot part, the second limiting part is provided with a second protruding part, one end of the second protruding part is inserted into a fourth groove recessed on a periphery of one end of the second bearing part, another end of the second protruding part is exposed outside the second bearing part, and the second protruding part of the second limiting part is optionally combined with the third groove of any one of the plurality of second angle positioning parts.

6. The multi-angle fine-adjustable bar as claimed in claim 1, wherein the plurality of second angle positioning parts are respectively provided with a plurality of second concave teeth, the plurality of second concave teeth are recessed on a periphery of a second end of the two ends of the second pivot part, the second limiting part is provided with a second protruding tooth, the second protruding tooth protrudes from a periphery of one end of the second bearing part, and the second protruding tooth of the second limiting part is optionally combined with the second concave tooth of any one of the plurality of second angle positioning parts.

7. The multi-angle fine-adjustable bar as claimed in claim 1, wherein quantities of the plurality of second angle positioning parts and the plurality of first angle positioning parts are equal or unequal, positions of the plurality of second angle positioning parts and the plurality of first angle positioning parts are disposed relative to one another or offset from one another, and the plurality of first angle positioning parts of the first angle selection area and the plurality of second angle positioning parts of the second angle selection area completely overlap or partially overlap with one another.

8. The multi-angle fine-adjustable bar as claimed in claim 1, wherein the third pivot part is provided with a first blocking part at a second end thereof to butt against a second end of the first pivot part, the first blocking part is provided with a bolt, one end of the bolt is locked to a screw hole recessed at the second end of the third pivot part, and another end of the bolt is exposed outside the third pivot part and butts against the second end of the first pivot part.

9. The multi-angle fine-adjustable bar as claimed in claim 1, wherein another end of the second bearing part of the position-limiting seat is provided with a first assembling part assembled on a first joint part of a bearing frame, the first joint part is connected to a first connecting part.

* * * * *